US007988604B2

(12) United States Patent
Barnett

(10) Patent No.: US 7,988,604 B2
(45) Date of Patent: Aug. 2, 2011

(54) FITNESS EQUIPMENT CABLE SAFETY APPARATUS

(75) Inventor: Ralph L. Barnett, Wilmette, IL (US)

(73) Assignee: Triodyne Safety Systems LLC, Northbrook, IL (US)

( * ) Notice: Subject to any disclaimer, the term of this patent is extended or adjusted under 35 U.S.C. 154(b) by 0 days.

(21) Appl. No.: 12/617,874

(22) Filed: Nov. 13, 2009

(65) Prior Publication Data

US 2010/0285935 A1 Nov. 11, 2010

Related U.S. Application Data

(60) Provisional application No. 61/176,725, filed on May 8, 2009.

(51) Int. Cl.
*A63B 21/062* (2006.01)

(52) U.S. Cl. ..... 482/99; 482/92

(58) Field of Classification Search ..... 482/99–104, 482/133, 134, 138, 139
See application file for complete search history.

(56) References Cited

U.S. PATENT DOCUMENTS

| | | | | |
|---|---|---|---|---|
| 345,286 | A * | 7/1886 | Dowd | 482/102 |
| 3,858,873 | A * | 1/1975 | Jones | 482/97 |
| 4,382,596 | A * | 5/1983 | Silberman | 482/102 |
| 4,784,384 | A * | 11/1988 | Deola | 482/99 |
| 4,799,671 | A * | 1/1989 | Hoggan et al. | 482/100 |
| 4,815,746 | A * | 3/1989 | Ward, Jr. | 482/104 |
| 4,998,723 | A * | 3/1991 | Santoro | 482/104 |
| 6,293,892 | B1 * | 9/2001 | Slawinski et al. | 482/104 |

FOREIGN PATENT DOCUMENTS

| | | | |
|---|---|---|---|
| DE | 3528994 | A1 * | 2/1987 |
| EP | 556677 | A1 * | 8/1993 |

OTHER PUBLICATIONS

Juran, J.M. and F.M. Gryna, "Juran's Quality Control Handbook," 4th ed. McGraw-Hill, New York, 1988, p. 16.38.
O'Connor, Patrick D.T., "Practical Reliability Engineering," 2nd ed, Wiley, New York, 1991, pp. 322-327.
Barnett, Ralph L., "Doctrine of Manifest Danger," Triodyne Safety Brief, vol. 8, No. 1, Sep. 1992 (19 pages).
ARINC Research Corporation, "Reliability Engineering," Prentice-Hall, Inc., Englewood Cliffs, NJ., © 1964, p. 199.
Greene, A.E. and A.J. Bourne, "Reliability Technology," Systems Reliability Service, U.K. Atomic Energy Authority, Wiley-Interscience, John Wiley & Sons, Ltd. 1972, p. 301.
American National Standards Institute, "American National Standard for Construction and Demolition Operations—Requirements for Safety Belts, Harnesses, Lanyards and Lifelines for Construction and Demolition Use," ANSI A10.14-1991, New York, 1991, p. 8.
http://idioms.thefreedictionary.com/, Cambridge International Dictionary of Idioms and the Cambridge Dictionary of American Idioms, © 2006(2 pages).

* cited by examiner

*Primary Examiner* — Loan Thanh
*Assistant Examiner* — Victor K Hwang
(74) *Attorney, Agent, or Firm* — Pauley Petersen & Erickson

(57) ABSTRACT

A safety cable system for a fitness device including a resistance load and a user interface device. A redundant cable apparatus connects the resistance load to the user interface device for lifting the resistance load by a force applied to the user interface device. The redundant cable apparatus comprises two cables extending in redundant cable paths between the resistance load and the user interface device. The two cables can share the resistance load or one of the cables can be dormant until failure of the other cable.

18 Claims, 10 Drawing Sheets

FITNESS EQUIPMENT CABLE SAFETY APPARATUS

CROSS REFERENCE TO RELATED APPLICATION

This application claims the benefit of U.S. Provisional Patent Application Ser. No. 61/176,725, filed on 8 May 2009. The co-pending Provisional Patent Application is hereby incorporated by reference herein in its entirety and is made a part hereof, including but not limited to those portions which specifically appear hereinafter.

BACKGROUND OF THE INVENTION

1. Field of the Invention

There is a family of exercise machines that provides a manual workout task requiring a user to push or pull against a resistance provided by a stack of weight plates. The weight system is usually linked with a single cable to a gripping or user interface device to produce a constant resistance. A fracture of the tensioned cable along its length or at its end connectors causes a sudden acceleration of the grip or other interface device driven by the operator's push or pull. The sudden loss of resistance often results in an exerciser pulling a heavy bar into his or her face. Because falling weights, accelerating grips, and rapidly unloading muscles are all hazardous, manufacturers of exercise machines want to maintain the structural integrity of the cables. To accomplish this, manufacturers usually recommend "scheduled servicing" of their cables. This preventive maintenance (PM) strategy is frustrated by nylon sheathing that hides cable damage or failures. Further, the swedged or silver soldered connectors often fail covertly by internal fatigue fractures. A more effective PM strategy has been adopted by many manufacturers called "scheduled replacement"; they advocate annual cable replacement. However, the owners of the machines may not follow a recommended replacement schedule in order to minimize costs or because of mere forgetfulness and/or lack of organization.

2. Description of Related Art

Hanging weights are generally used to provide a constant resistance over the full pulling range on fitness equipment. These weights are usually suspended by a cable mechanism that transfers a selected gravity load to various portions of a human body through handles or foot pedals. This is illustrated by the stripped down fitness machine 20 shown in FIG. 1. In FIG. 1 a user interface device 22, i.e., a pull down bar, is connected to a resistance load 24 including an adjustable weight plate stack by a cable 26. Manufacturers typically use an aircraft cable (e.g., seven strands with 19 wires per strand) that is 3/16 inch in diameter and covered in a nylon sheath. This highly redundant wire rope is typically composed of 133 wires, and incorporates end connectors that are usually swedged and/or silver soldered.

Fitness equipment manufacturers generally advocate PM techniques for maintaining the structural integrity of the cables. Preventive maintenance is defined as actions performed in an attempt to retain an item in a specified condition by providing systematic inspection, detection and prevention of incipient failure by repairing or replacing it. This concept must be contrasted with corrective maintenance which restores an item to a specified condition after it has failed. Two principal PM techniques are scheduled servicing and scheduled replacement.

Scheduled servicing is comprised of scheduled maintenance strategies which reveal incipient failures of items for the purpose of preventing system failures. Various servicing protocols are involved:

a) Inspection—detection of self-revealing deteriorating conditions of items composing the system.

b) Non-destructive testing—a body of testing techniques and methods which will not compromise the item tested.

c) Cleaning d) Lubrication e) Calibration f) Adjustment g) Repair (if required)

Daily or weekly visual inspection of belts and/or cables on fitness machines for any signs of wear, fraying, de-lamination and/or stretching can be very effective for identifying damaged sheathing; on the other hand, it is an impoverished procedure for identifying the onset of fatigue failure. Fatigue of wire rope typically manifests itself by successive failures of the constituent wires which form wire fractures, often called "fish hooks," on the cable surface. Wire rope is a highly redundant tension member that communicates its compromised structural integrity before it fully separates (Barnett, Ralph L., "Doctrine of Manifest Danger," Triodyne Safety Brief, Vol. 8, No. 1, September 1992). Unfortunately, the nylon sheathing that covers most fitness machine cables hides most wire failures. Furthermore, wire rope failure may occur inside of the end fasteners where no visual feedback is available.

Scheduled replacement involves the replacement of parts at predetermined times before failure. When the onset of failure of an item cannot be determined, scheduled replacement is the only PM strategy available. Reliability analysis techniques are required to develop replacement schedules that will minimize the number of items which fail. On the other hand, inefficient replacement or maintenance schedules may be adopted through trial and error or anecdotal observations. Most manufacturers recommend a scheduled replacement of belts or cables every one or two years.

Keeping track of the age of fitness machine cables requires discipline. Throwing away one-year-old cables with no apparent damage also goes against the grain of frugality and resource conservation. "Changing out" cables that are inspected daily is work. Many sizes of new cables must be ordered and inventoried, and operations must be interrupted while new cables are installed. It is easier to ignore scheduled replacement and replace only broken cables or ones with compromised appearance.

There is a need for an improved cable safety system that provides that reduces or eliminates the risk of injury due to cable failure while limiting cost by not replacing structurally sound cables.

SUMMARY OF THE INVENTION

This invention provides a safety mechanism for fitness equipment that use cables to lift or otherwise move resistance loads such as weight stacks. In one embodiment of this invention, a redundant duplication of the cable system is provided to distribute the load of a fitness machine, referred to as active redundancy. In another embodiment of this invention, a dormant or standby redundancy is used to provide the requisite safety. The dormant redundancy system of this invention not only reduces or eliminates the danger of cable failure, it provides the most economical use of the cable in the sense that a cable is not discarded until its life is exhausted.

The general object of the invention can be attained, at least in part, through a safety cable system for a fitness device including a resistance load and a user interface device. A redundant cable apparatus connects the resistance load to the user interface device for lifting the resistance load by a force applied to the user interface device. The redundant cable apparatus comprises two cables extending in redundant cable paths between the resistance load and the user interface device.

The invention further comprehends a fitness device. The fitness device has a resistance load that includes a load connector. The fitness device also includes a user interface device and a first cable extending in a cable path between the load connector and the user interface device. A second cable extends in a redundant cable path between the load connector and the user interface device, where a distance of the redundant cable path is less than a distance of a cable path.

The invention still further comprehends a fitness device with a resistance load and a user interface device. A first cable includes a first end connected to the interface device and a second end connected to the load connector for lifting the resistance load by a force applied to the user interface device. A second cable that is independent of the first cable also includes a first end connected to the interface device and a second end connected to the load connector. A distance of a cable path of the second cable from the user interface device to the load connector is less than a distance of a cable path of the first cable from the user interface device to the load connector. The cable path of the second cable to the load connector can be provided by an offset load connector. The offset cable path results in a slackening of the second cable when the cables are the same length. A spring or gravity-based tension mechanism can be used to remove the slack in the second cable, while relying on the first cable to do all or substantially all of the load lifting within the fitness machine.

Active parallel redundancy according to this invention incorporates the addition of a duplicate of the original cable system. This type of fail-safe design is very effective for preventing catastrophic failure of the cable system when, for example, the cable elements contain random defects or suffer traumatic assaults. The application of the dormant standby redundancy of this invention provides a brand new standby cable as a sentinel to keep watch over the original primary load carrying cable that supports the weight plates. Failure of the primary cable by the formation of overt faults, covert faults, or trauma, will cause a new cable to take over the function of the original load bearing cable system. When the primary load bearing cable fractures, it assumes a serpentine profile that typically wraps around the fitness machine to inform the user of a component failure. The standby cable, which is essentially brand new, will completely support the weight stack under any weight use profile. The subjectiveness and human error associated with the PM strategies are almost completely eliminated with the use of safety system of this invention.

In addition, the original cable may be used for periods much longer than, for example, one year. The cable life will be determined either by overt failures of the nylon coating which can cause excessive wear in the pulleys or upon fracture of the cable system by covert faults or external trauma. In the dormant standby redundancy, upon failure of the primary cable, the standby cable takes its place and a new cable is substituted for the standby cable. In this way, the full life of each cable is utilized, and the interval between cable replacements is greatly extended. The system of this invention is extremely flexible in its application, and can be adapted to work with various and alternative fitness machine types and configurations, independent of a particular manufacturer. The safety devices of this invention can be implemented in newly manufactured equipment or through retrofit kits in various existing machines.

As used herein, references to "cable" are to be understood to refer to any element, such as cables, wire ropes, chains, or belts of various materials, that can be used in a fitness machine for lifting or otherwise moving a resistance load.

References to "resistance load" are to be understood to refer to any load lifted or otherwise moved by a user using a fitness machine, such as, without limitation, stacked weight plates, user-added weight plates, or resistance bands or rods.

References to "user interface device" are to be understood to refer to any component or mechanism used by a consumer user to interact with and activate the fitness machine to lift the resistance load. The user interface device is typically at an opposite end of a cable from the resistance load, and can be a simple handle-type device for attaching essentially directly to a cable or a larger, more complex mechanism with one or more fixed and/or movable components, such as are often fixed and/or integral parts of the fitness machine.

Further, references herein to "cable path" are to be understood to refer to the general placement, track, or course of a cable assembled in a fitness machine. The cable travels within the cable path during use of the machine to lift a load.

BRIEF DESCRIPTION OF THE DRAWINGS

The objects and features of the invention will be better understood from the following detailed description taken in conjunction with the appended drawings.

DETAILED DESCRIPTION OF THE INVENTION

This invention provides a safety system for fitness machines that use cables to lift or otherwise move resistance loads such as weight plate stacks. The safety system of this invention desirably lengthens the life of the cables and/or provides a fail-safe design when a fault, i.e., cable break, occurs. The invention incorporates cable redundancy, by substituting two cable systems for the original one cable system.

Figure 2:
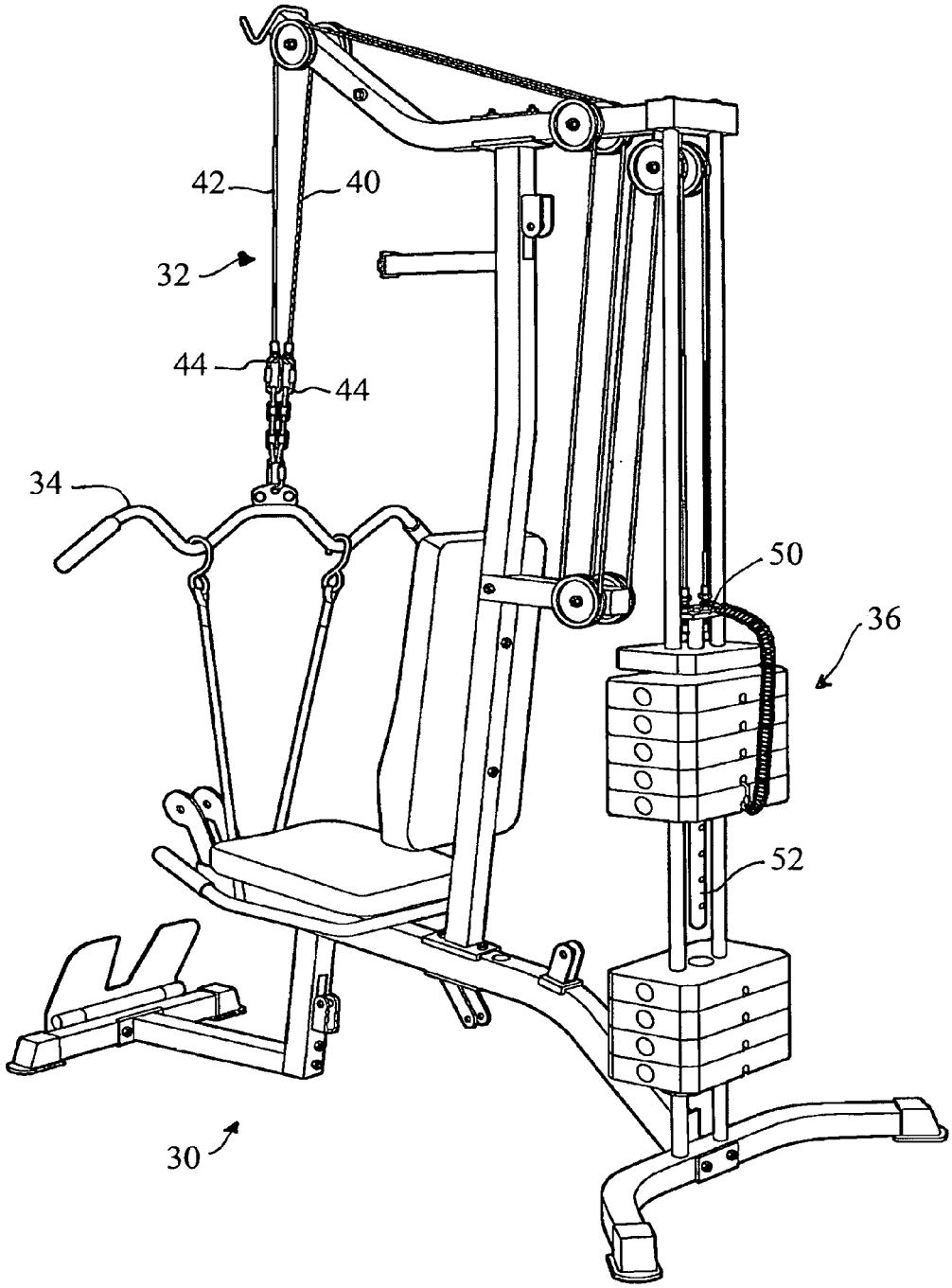
FIG. 2 shows a fitness machine including an active redundant cable system according to one embodiment of this invention.

FIG. 2 illustrates an exemplary fitness device 30 including a safety cable system 32 according to one embodiment of this invention. The fitness device includes a user interface device 34 connected to a resistance load 36 by the cable system 32. The user interface device 34 is shown as a pull down bar, but can be any device or handle suitable for this or another fitness machine. Other examples of user interface devices include triceps bars, rope handles, shoulder press bars, leg extension bars or devices, leg curl bars or devices, chest press bars, and biceps curl bars. The safety system of this invention can be used with most if not all user interface devices that connect to a resistance load by cables. The user interface device can be a substitutable attachment, such as the pull down bar in FIG. 2, or can be a fixed and relatively complex device, such as including a cam structure as shown, for example, in FIG. 7, 9, or 11, for attaching to the cables, such as is often found in commercial triceps and biceps machines. The resistance load 36 is shown as a common pin-adjustable weight plate stack, but can be any known resistance load, such as a bar for receiving Olympic or other style weight plates.

Figure 1:
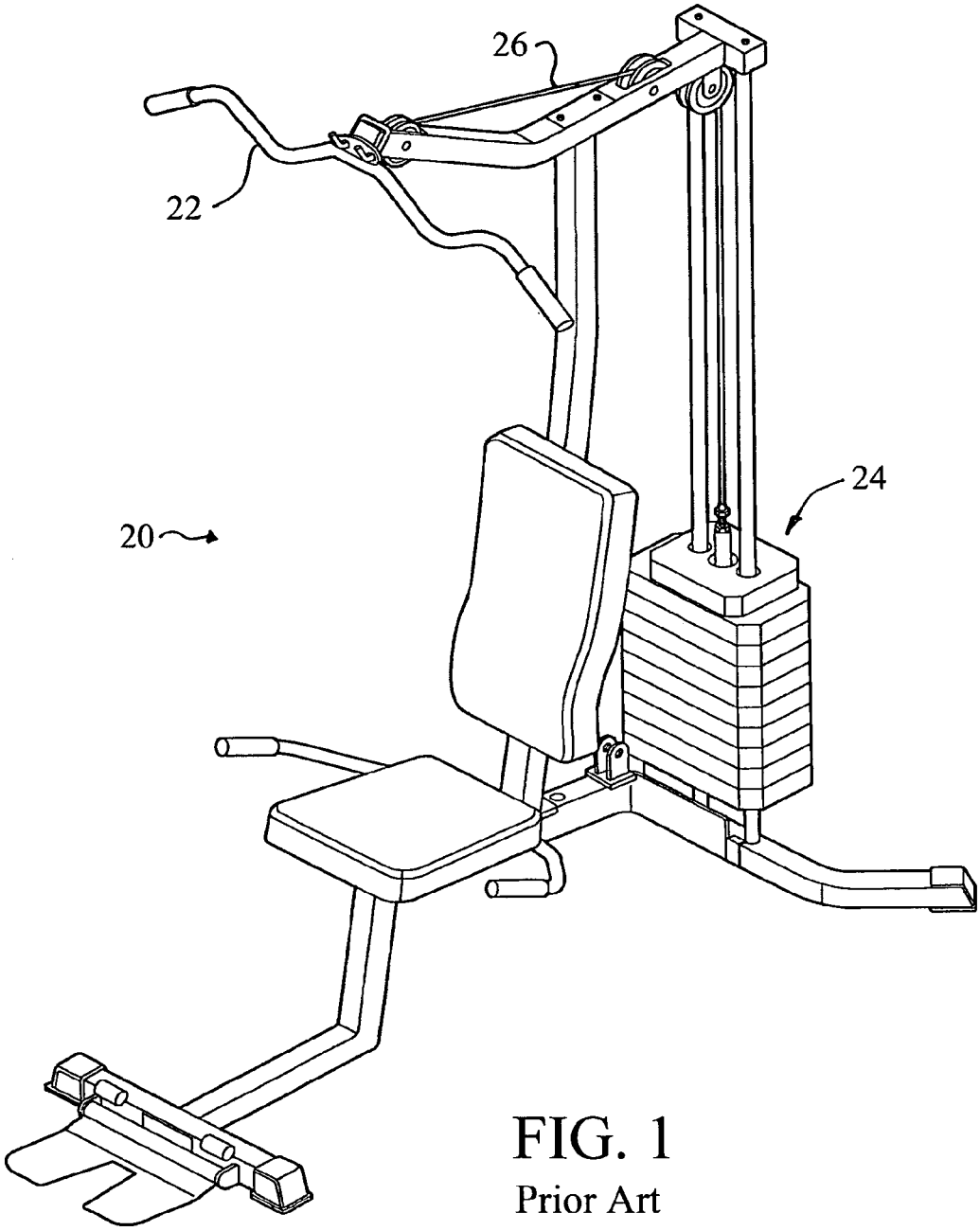
FIG. 1 Prior Art
FIG. 1 shows an exemplary known fitness machine.

The safety cable system 32 shown in FIG. 1 is a redundant cable apparatus connecting the resistance load 36 to the user interface device 34 for lifting the resistance load 36 by a force applied to the user interface device 34. The redundant cable apparatus 32 includes two cables 40 and 42 each connected at a first end to the user interface device 34 and at a second end to the resistance load 36. The cables can be any suitable cables known for use in fitness machines, such as coated metal wire cables. The ends of the cables can be looped and/or fitted with various end connectors, depending on need, which can be applied using known methods such as swedging and/or soldering. The connection of the cables 40 and 42 with the user interface device 34 can be accomplished using locking carabineers or clasps 44 as shown, or by any other suitable means.

Figure 3:
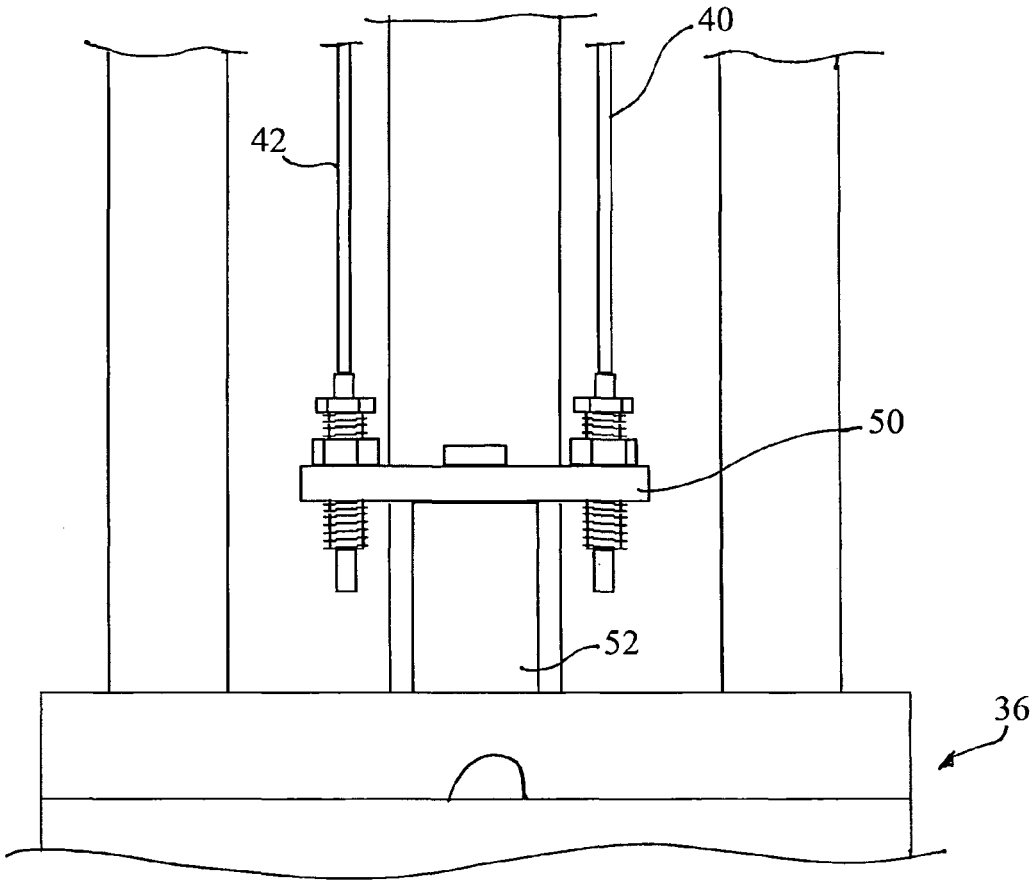
FIG. 3 shows a weight stack connection according to one embodiment of this invention.

FIG. 3 shows a view of a load connector 50 for connecting the cables 40 and 42 to the weight selector rod 52. The load connector 50 shown in FIG. 3 comprises a flat metal bracket piece providing a connection point for the two cables 40 and 42 on opposing sides of the weight selector rod 52. As shown in FIGS. 2 and 3, the two cable 40 and 42 are aligned in independent and aligned and/or coextensive cable paths. The two cable 40 and 42 thus extend in redundant cable paths between the resistance load 36 and the user interface device 34. In the embodiment shown in FIGS. 2 and 3, the redundant cable apparatus operates using an active parallel redundancy approach.

Active redundancy in this invention is characterized as redundancy wherein all redundant items are operating simultaneously rather than being switched on when needed. The fitness machine 30 in FIG. 2 includes a duplicate of the original cable system shown in FIG. 1. Because of symmetry, each of the cables 40 and 42 shown in FIG. 2 shares the load 36 equally. The resulting lower stress in each cable 40 and 42 will extend its life. In addition, when one of the cables 40 or 42 fails, the surviving cable can continue to carry the load 36 and the failed cable will give notice of the component failure. In this way, the active redundancy of safety cable system 32 can improve the system reliability. The cable redundancy will harden the system 32 against traumatic insult to any one of the cables 40 and 42.

Figure 4:
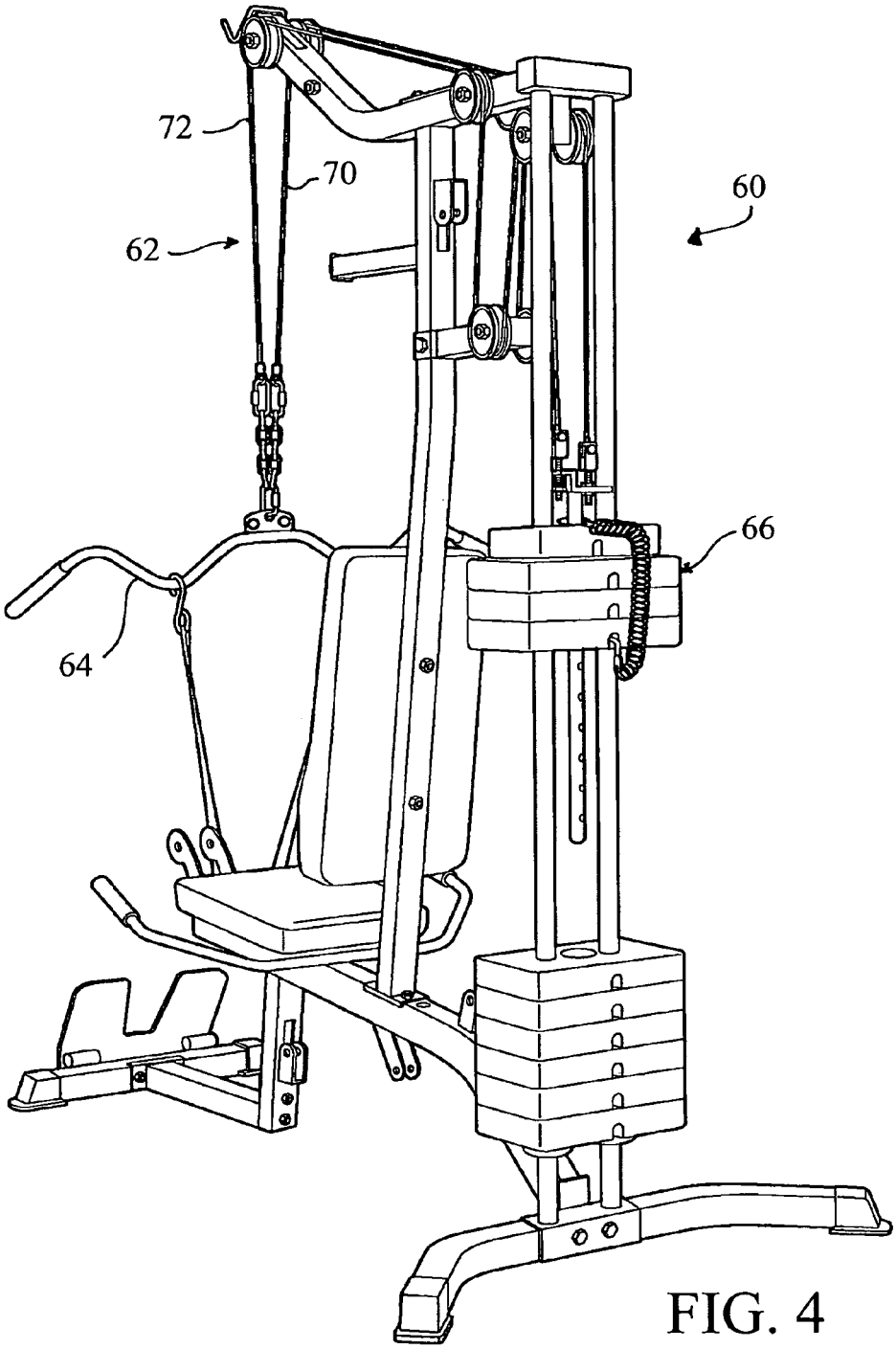
FIG. 4 shows a fitness machine including a dormant redundant cable system according to one embodiment of this invention.

FIG. 4 illustrates an exemplary fitness device 60 including a safety cable system 62 according to another embodiment of this invention. The fitness device 60 includes a user interface device 64 connected to a resistance load 66 by the cable system 62. Cable system 62 includes a first cable 70 with a first end connected to the interface device 64 and a second end connected to the resistance load 66, for lifting the resistance load 66 by a force applied to the user interface device 64. The cable system 62 also includes a redundant second cable 72 that is independent of the first cable 70 and that also includes a first end connected to the interface device 64 and a second end connected to the resistance load 66.

The fitness device 60 illustrates a second embodiment of a failsafe design for the safety cable system of this invention. The cable safety system 62 uses dormant standby redundancy, whereby one of the cables, i.e., cable 72, is partially or fully inoperative until needed upon the failure of the primary means of performing the function. The second cable 72 remains dormant, either partially or fully, until the first cable 70 is disengaged, such as by breaking.

In one embodiment of this invention, the dormant cable 72 can have a substantially identical length to the active primary cable 70, but a distance of the redundant cable path is less than a distance of an active cable path. In one embodiment, the shorter cable path is provided by offsetting the connection of one or both ends of the dormant second cable 72 to the interface device 64 or the resistance load 66 from the connection of one or both ends of the active first cable 70 to the interface device 64 or the resistance load 66.

Figure 5:
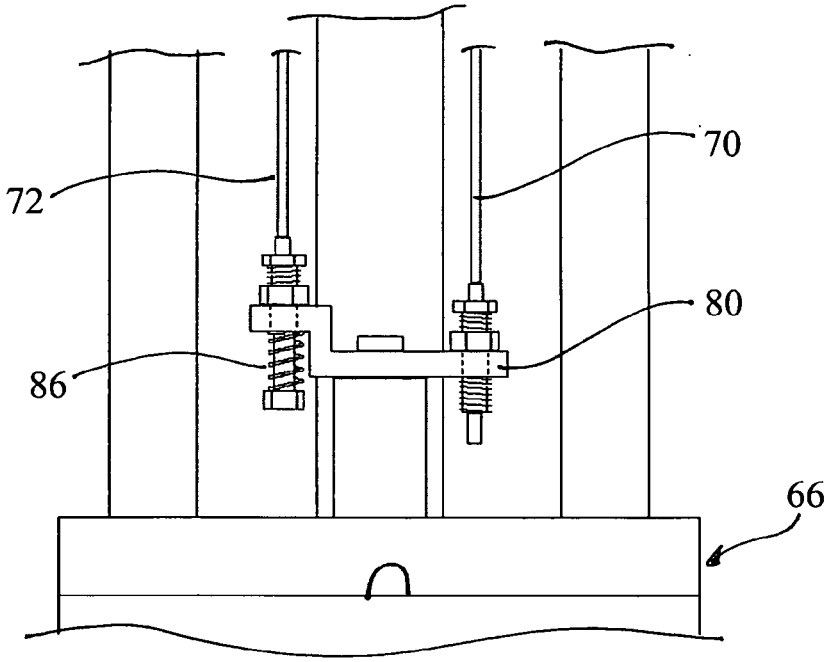
FIG. 5 shows an offset load connector according to one embodiment of this invention.

FIG. 5 illustrates a load connector 80 that provides a connection of the second cable 72 to the resistance load 66 that is offset from the connection of the first cable 70. The load connector 80 is shown as an offset plate having a first arm 82 parallel to but disposed lower than a second arm 84. The second cable 72 is connected to the second arm 84 and the first cable 70 is connected to the first arm 82, allowing for a connection of the second cable 72 to the resistance load 66 in an offset position from the first cable 70. In this embodiment, the end of the second cable extends through and beyond the second arm 84, and a compression spring 86 is disposed between the end 76 of the cable 72 and the underside of the second arm 84. The compression spring 86 is a tension mechanism that in this embodiment pushes the end 76 of the second cable 72 away from the offset arm 84 to remove slack from the offset cable 72. The tension mechanism provides a taut cable to maintain the second cable 72 within the appropriate pulleys of the machine 60 during use of the machine 60. Various and alternative sizes, shapes, and/or configurations are available, depending on need and the particular fitness equipment, for the load connector and/or the compression spring of this invention. The cylindrical compression spring 86 can, for example, be replaced by a conical spring that provides a shorter compressed height.

Figure 6:
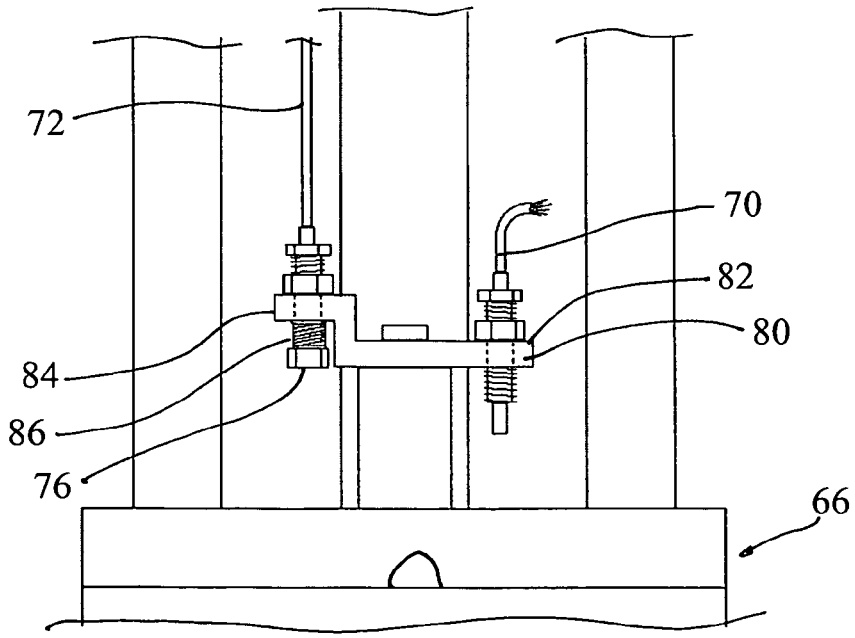
FIG. 6 illustrates the load connector of FIG. 5 upon the failure of the primary cable.

The dual cables 70 and 72 are affixed to the resistance load 66 by the offset load connector 80 and compression spring 86. Any force applied to the dormant second cable 72 merely shortens the compression spring 86, which limits the second cable 72 loading to much less than the first cable 70. The entire or almost the entire resistance load 66 is lifted by the primary first cable 70. When the first cable 70 or its terminations are fractured because of trauma or fatigue, such as shown in FIG. 6, the resistance load 66 is automatically switched to the "like new" second cable 72 which bottoms out the compression spring 86 as shown in FIG. 6. The broken first cable 70 assumes a serpentine geometry within the machine 60 that notifies the operator of a component failure.

When the primary first cable 70 fractures, its load is transferred to the second cable 72 through the compression of the spring 86. The resistance load falls less than the length of the spring 86, for example, about an inch. The broken cable 70 manifests its fracture while an almost new cable 72 continues to support the exercise activity. After the failure, the standby second cable 72 can be moved to the primary position to become the primary load bearing cable. A new cable is substituted for the second cable 72 and becomes the dormant standby cable. In this manner, the full life of the first cable 72 has been realized, a benefit over a scheduled replacement PM protocol which throws away cables which may have substantial remaining life.

Figure 7:
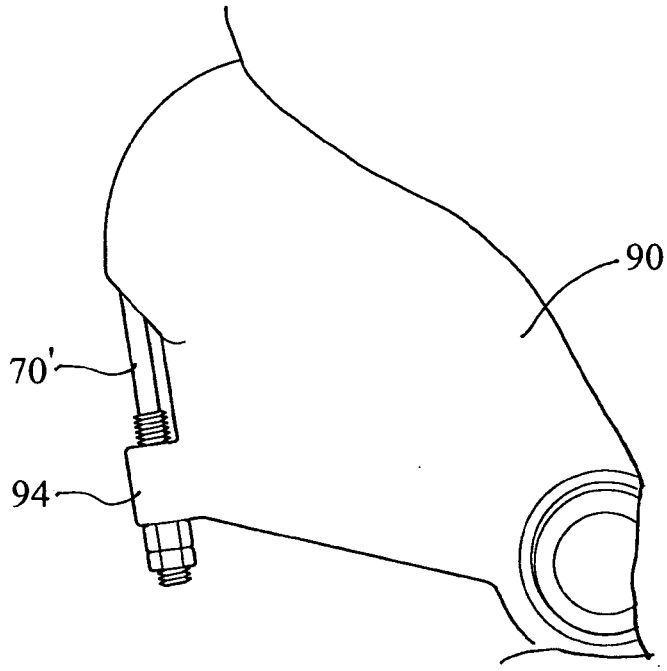
FIG. 7 shows a load connector for attachment of a cable to a cam of a fitness machine, according to an embodiment of this invention.
Figure 8:
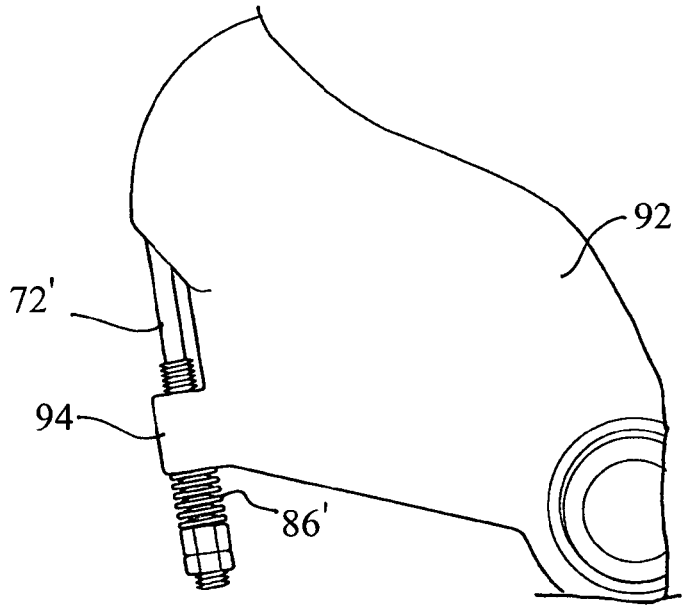
FIG. 8 shows a redundant cam termination according to an embodiment of this invention.
Figure 9:
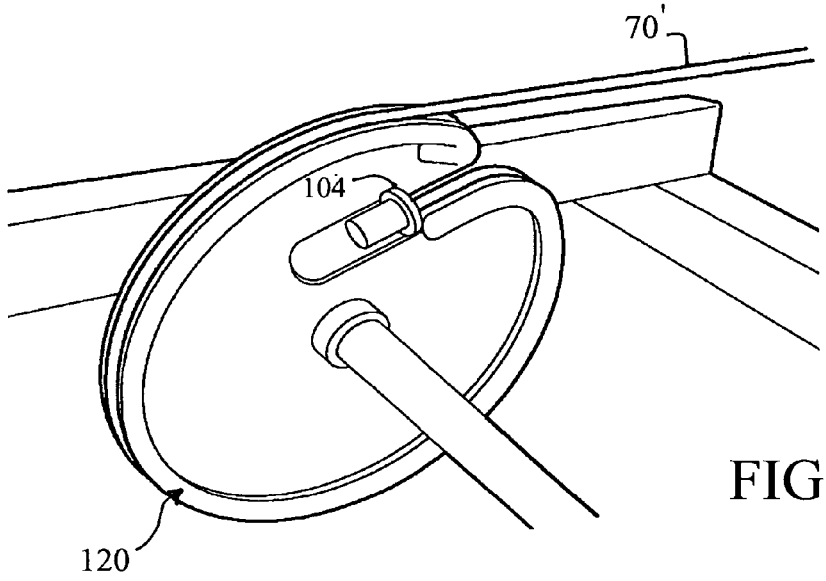
FIG. 9 shows a load connector for attachment of a cable to a cam of a fitness machine, according to another embodiment of this invention.
Figure 10:
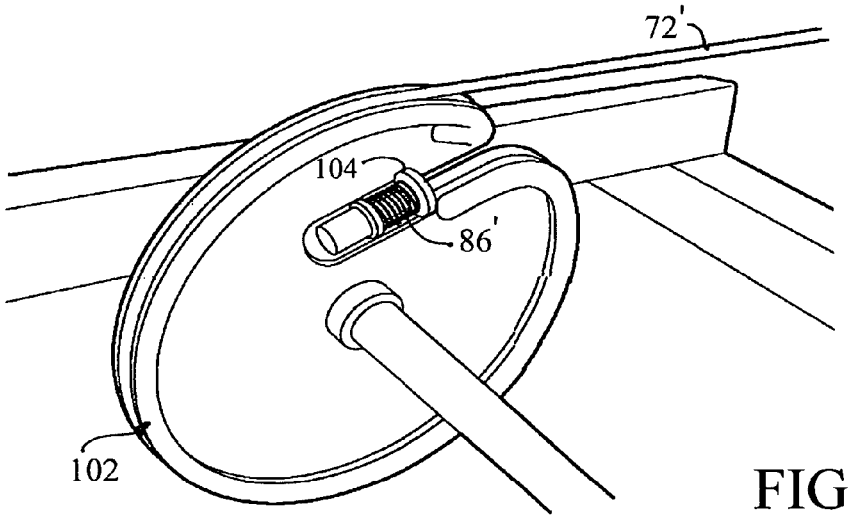
FIG. 10 shows a redundant cam termination according to another embodiment of this invention.

The dormant standby redundant safety cable system of this invention provides a flexible strategy that is easily applied to fitness machines with different configurations, such as shown in FIGS. 7-12. FIG. 7 shows a first cable 70' in combination with a cam mechanism 90. FIG. 8 shows a similar cam mechanism 92 adapted with a second and dormant cable 72'. The cam 92 can be modified from cam 90 to, for example, move the cable connector 94 upstream to provide a shorter cable path for cable 72'. Alternatively, the connection at the other end of cable 72' can be offset to extend the cable 72' beyond the cable connector 94 to allow for spring 86'. FIG. 9 shows a first cable 70' in combination with a different embodiment of a cam mechanism 100. FIG. 10 shows a similar cam mechanism 102 adapted with a second and dormant cable 72'. In FIG. 10, the connection at the other end of cable 72' is offset to extend the cable 72' beyond the cable connector 104 to allow for spring 86'.

Figure 11:
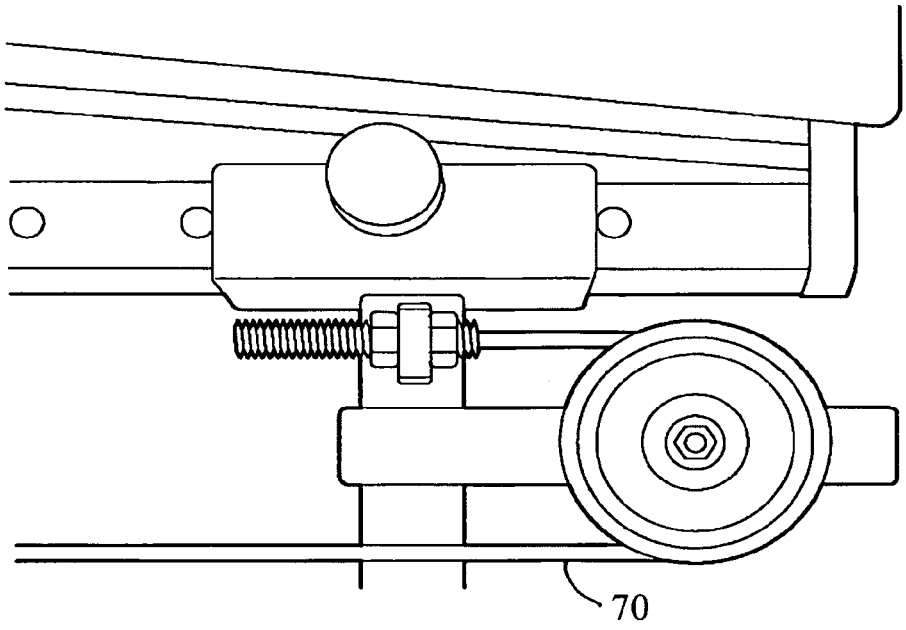
FIG. 11 shows a load connector for attachment of a cable to a primary cam of a fitness machine, according to yet another embodiment of this invention.
Figure 12:
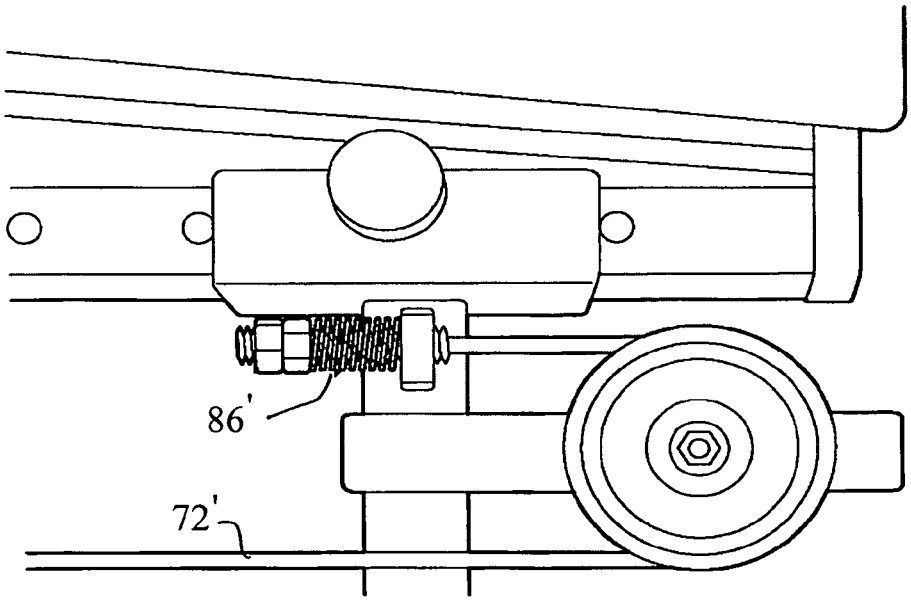
FIG. 12 shows a redundant cam termination according to yet another embodiment of this invention.

The particular cam mechanism embodiments are shown to generally illustrate the principles and flexibility of the inventive cable safety system. As will be appreciated by those skilled in the art following the teachings herein provided, the redundant safety cable system of this invention can be adapted for use in various fitness machine configurations of the cam mechanism. For example, in one embodiment of this invention, the cams illustrated in FIGS. 7-10 can be part of a user interface device, and the active cam and dormant cam can be formed integral to each other, positioned next to each other, or even disposed at opposing sides of a user interface device. FIGS. 11-12 show another fitness machine pulley setup with an active first cable 70' (FIG. 11) and then with a dormant second cable 72' (FIG. 12).

Figure 13:
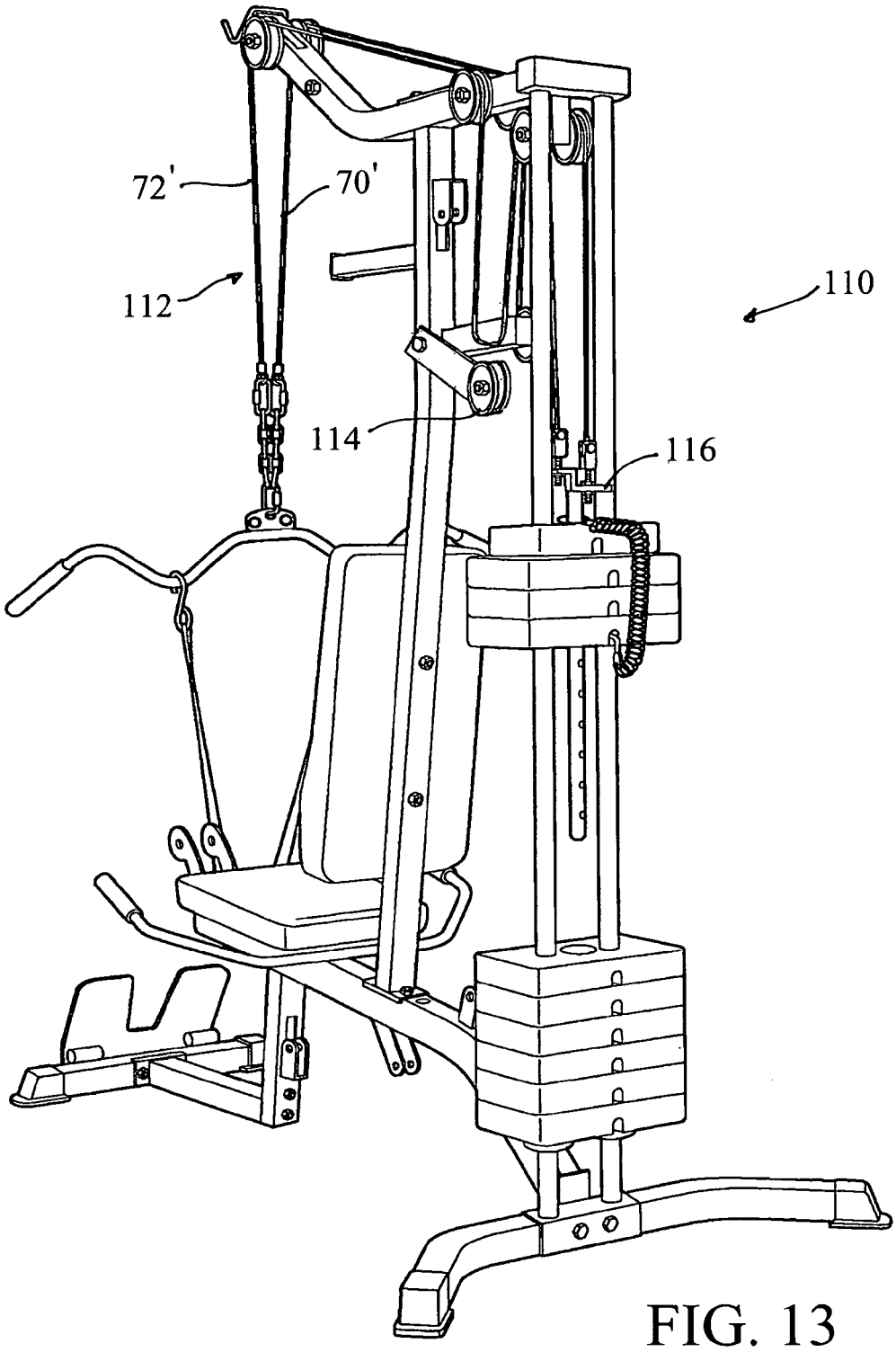
FIG. 13 shows a fitness machine including a dormant redundant cable system according to another embodiment of this invention.
Figure 14:
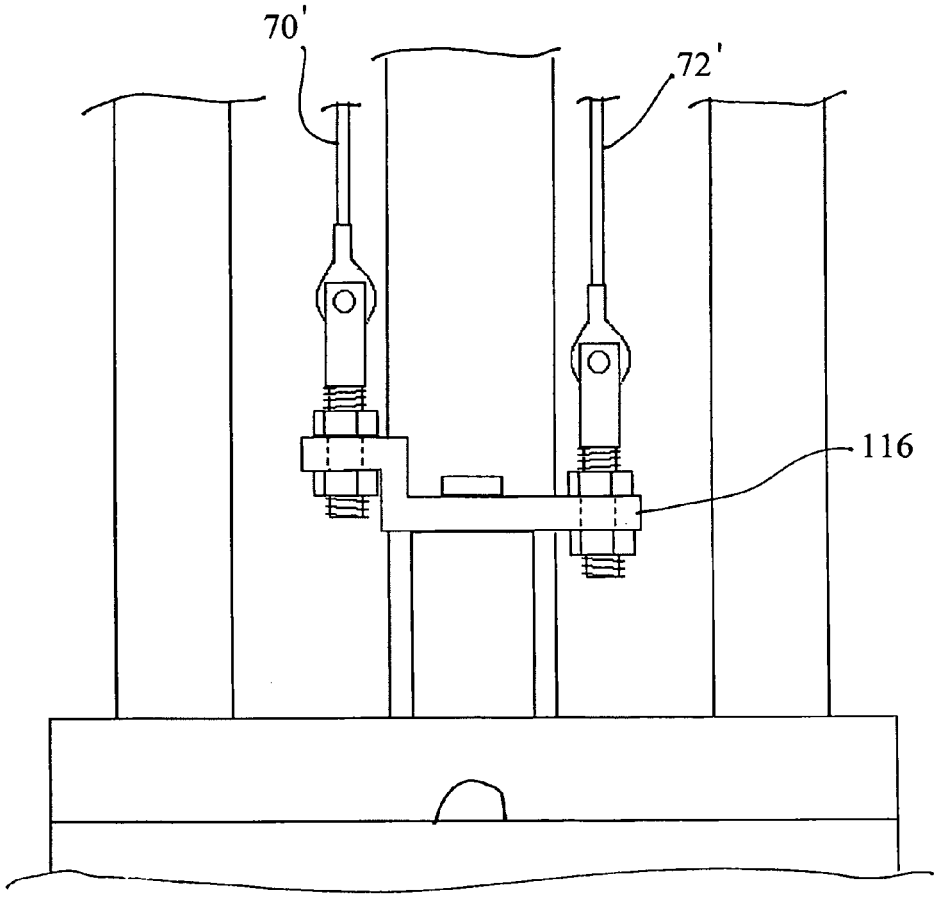
FIG. 14 shows the load connector of the fitness machine of FIG. 13.

It should be further appreciated that various and alternative configurations of the tension mechanism are available for use with this invention. FIG. 13 is a fitness machine 110 incorporating a safety cable device 112 according to another embodiment of this invention. The safety cable device 112 replaces the compression spring discussed above with a gravity or spring loaded idler roller 114 which takes up the slack in the dormant standby cable 72'. The roller 114 is shown in FIG. 13 disengaged from the cable 72' to demonstrate the downward tendency of the roller 114. As shown in FIGS. 13 and 14, the load connector 116 is shown as an offset plate, as discussed above, for shortening the cable path of second cable 72'. The downward tendency of the idle roller 114 works against the cable 72' to remove slack during operation of the fitness machine 110.

Thus, the invention provides a safety cable device employing active and/or dormant redundancy to provide a total backup to the original fitness machine cable system in the event of cable failure. The implementation of this invention helps reduce or eliminate the subjectiveness and human error associated with current PM strategies. Using dormant redundant cable system of this invention, the full life of each of the cables is taken advantage of, thereby reducing cable replacement costs compared to current scheduled replacement.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A safety cable system for a fitness device including a resistance load and a user interface device, the safety cable system comprising:

a redundant cable apparatus connecting the resistance load to the user interface device for lifting the resistance load by a force applied to the user interface device, the redundant cable apparatus comprising two cables extending in redundant cable paths between the resistance load and the user interface device, wherein the two cables have a substantially equal length and a cable path distance of a second cable of the two cables from the user interface device to the resistance load is less than a cable path distance of a first of the two cables from the user interface device to the resistance load, and further comprising a tension mechanism for keeping the second cable taut.

2. The safety cable system according to claim 1, further comprising a load connector for connecting the two cables to the resistance load, wherein the two cables are each connected at a first end to the load connector and at a second end to the user interface device.

3. The safety cable system according to claim 1, wherein the second cable of the two cables is dormant until the first cable of the two cables is disengaged.

4. The safety cable system according to claim 3, wherein the second cable is connected to the resistance load or the user interface device in an offset position from the first cable.

5. The safety cable system according to claim 1, wherein the tension mechanism comprises a spring.

6. A safety cable system for a fitness device including a resistance load and a user interface device, the safety cable system comprising:

a redundant cable apparatus connecting the resistance load to the user interface device for lifting the resistance load by a force applied to the user interface device, the redundant cable apparatus comprising two cables extending in redundant cable paths between the resistance load and the user interface device, wherein a second cable of the two cables is dormant until a first cable of the two cables is disengaged, and the second cable is connected to the resistance load or the user interface device in an offset position from the first cable; and a tension mechanism for keeping the second cable taut while the second cable is dormant, wherein the tension mechanism comprises a spring.

7. A safety cable system for a fitness device including a resistance load and a user interface device, the safety cable system comprising:

a redundant cable apparatus connecting the resistance load to the user interface device for lifting the resistance load by a force applied to the user interface device, the redundant cable apparatus comprising two cables extending in redundant cable paths between the resistance load and the user interface device, wherein a second cable of the two cables is dormant until a first cable of the two cables is disengaged, and the second cable is connected to the resistance load or the user interface device in an offset position from the first cable; and a load connector for connecting the two cables to the resistance load, the load connector comprising a first arm for connecting to the first cable and a second arm for connecting to the second cable, the second arm offset from the first arm, wherein the load connector provides a distance of a cable path of the second cable from the user interface device to the load connector that is less than a distance of a cable path of the first cable from the user interface device to the load connector.

8. The safety cable system according to claim 7, wherein the two cables have a substantially equal length and further comprising a tension mechanism for keeping the second cable taut.

9. A fitness device, comprising:

a resistance load;

a user interface device;

a first cable extending in a cable path between the resistance load and the user interface device;

a second cable extending in a redundant cable path between the resistance load and the user interface device, wherein a distance of the redundant cable path is different than a distance of the cable path and the second cable is dormant until the first cable is disengaged.

10. The fitness device according to claim 9, wherein the second cable is connected to the resistance load or the user interface device in an offset position from the first cable.

11. A fitness device, comprising:

a resistance load;

a user interface device;

a first cable extending in a cable path between the resistance load and the user interface device;

a second cable extending in a redundant cable path between the resistance load and the user interface device, wherein a distance of the redundant cable path is less than a distance of the cable path and the second cable is connected to the resistance load or the user interface device in an offset position from the first cable; and a tension mechanism for keeping the second cable taut.

12. The fitness device according to claim 11, wherein the tension mechanism comprises a compression spring.

13. A fitness device, comprising:

a resistance load;

a user interface device;

a first cable extending in a cable path between the resistance load and the user interface device;

a second cable extending in a redundant cable path between the resistance load and the user interface device, wherein a distance of the redundant cable path is less than a distance of the cable path; and a load connector connected to the resistance load and including a first arm connected to the first cable and a second arm connected to the second cable, the second arm offset from the first arm, wherein a distance of the redundant cable path of the second cable from the user interface device to the load connector is less than a distance of the cable path of the first cable from the user interface device to the load connector.

14. A fitness device, comprising:

a resistance load including a load connector;

a user interface device;

a first cable including a first end connected to the user interface device and a second end connected to the load connector, for lifting the resistance load by a force applied to the user interface device;

a second cable independent of the first cable and including a first end connected to the user interface device and a second end connected to the load connector;

wherein a distance of a second cable path of the second cable from the user interface device to the load connector is different than a distance of a first cable path of the first cable from the user interface device to the load connector and the second cable is dormant until the first cable is disengaged.

15. The fitness device according to claim 14, wherein the second cable is connected to the load connector or the user interface device in an offset position from the first cable.

16. The fitness device according to claim 14, further comprising a tension mechanism for keeping the second cable taut, the tension mechanism comprising a compression spring.

17. The fitness device according to claim 14, wherein the load connector comprises a first arm connected to the first cable and a second arm connected to the second cable, the second arm offset from the first arm, wherein a distance of the second cable path of the second cable from the user interface device to the load connector is less than a distance of the first cable path of the first cable from the user interface device to the load connector.

18. The fitness device according to claim 17, further comprising a tension mechanism for keeping the second cable taut, the tension mechanism comprising a compression spring disposed between an end of the second cable and the second arm.

* * * * *